United States Patent [19]

Fujiwara et al.

[11] Patent Number: 4,507,701

[45] Date of Patent: Mar. 26, 1985

[54] LIGHTING ARRESTER WITH LEAKAGE CURRENT DETECTION

[75] Inventors: Yukio Fujiwara; Seiji Sonoyama; Mitsumasa Imataki, all of Amagasaki, Japan

[73] Assignee: Mitsubishi Denki Kabushiki Kaisha, Tokyo, Japan

[21] Appl. No.: 507,387

[22] Filed: Jun. 24, 1983

[30] Foreign Application Priority Data

Jul. 6, 1982 [JP] Japan ..... 57-103417

[51] Int. Cl.[3] ..... H02H 9/04

[52] U.S. Cl. ..... 361/127; 361/130; 324/72 R; 324/102; 340/647; 340/664

[58] Field of Search ..... 361/127, 126, 117, 130, 361/110; 324/72 R, 54, 102; 340/664, 647, 650, 653

[56] References Cited

U.S. PATENT DOCUMENTS

| | | | |
|---|---|---|---|
| 2,928,016 | 3/1960 | Schultz | 361/130 |
| 3,443,223 | 5/1969 | Kennon | 324/72 |
| 3,469,188 | 9/1969 | Hall | 324/72 X |
| 4,259,666 | 3/1981 | Takahashi et al. | 340/647 |
| 4,338,648 | 7/1982 | Subbarao | 361/127 |

FOREIGN PATENT DOCUMENTS

| | | | |
|---|---|---|---|
| 34043 | 3/1979 | Japan . | |
| 144946 | 12/1979 | Japan | 361/127 |

*Primary Examiner*—Patrick R. Salce
*Attorney, Agent, or Firm*—Sughrue, Mion, Zinn, Macpeak and Seas

[57] ABSTRACT

A lightning arrester comprises nonlinear resistance discs 2 stacked within a ceramic casing 1, with annular metal cover rings 3, 4 being fixed to the opposite outer ends of the casing. Conductive plates 5, 19 having reduced thickness rupturable central portions are sealed to the inner ends of the casing, with the lower plate 19 being insulated from the lower ring 4 by an insulating ring 20. An ammeter 16 is connected between the conductive plate 19 and ground by a lead wire 21 passing through the ring skirt but insulated therefrom, whereby only leakage current passing through the nonlinear resistance discs is sensed.

8 Claims, 7 Drawing Figures

LIGHTING ARRESTER WITH LEAKAGE CURRENT DETECTION

BACKGROUND OF THE INVENTION

This invention relates to a lightning arrester having a nonlinear resistance.

DESCRIPTION OF THE PRIOR ART

Lightning arresters having nonlinear resistances are widely known, as exemplified by U.S. Pat. Nos. 2,928,016 and 3,443,223.

Referring to FIG. 1 which illustrates a typical conventional lightning arrester, nonlinear resistance discs 2, formed of sintered zinc oxide or the like, are stacked within a ceramic casing 1 having radial flanges or fins for increasing the electrical "creep" discharge distance. Generally annular metal cover rings 3, 4 having upstanding cylindrical side walls are fixed to the outer end portions of the casing 1. Conductive plates 5, 6 seal off the casing ends, and have annular grooves for receiving O-rings 7, 8 and reduced thickness central portions adapted to rupture or burst upon the application of a lightning magnitude voltage, to thereby relieve the pressure within the casing before it reaches a dangerous or explosive level. Metallic spacers 9, 10 support the discs 2 and establish electrical connection between the resistance discs and the plates 5, 6. Conductive cover plates 11, 12 serve as terminals, and are mounted on the end rings 3, 4. The foregoing structure is mounted atop a ceramic tube 13 having spaced upper and lower metallic end rings 14, 15. An ammeter 16 connected between the lower cover plate 12 and ground 17 is used to measure the leakage current flowing through a lead 18, the upper cover plate 11, the ring 3, the plate 5, the spacer 9, the resistance discs 2, the spacer 10, the plate 6, and the ring 4.

The characteristics of the nonlinear resistance discs are such that they function collectively as an insulator at a rated voltage, with a leakage current flow in the multi-microampere ($\mu$a) range, and as a very low resistance conductor in the presence of an abnormally high voltage on a protected line. The abnormal voltage is thus grounded by a high current flow through the resistance discs, and any electrical equipment connected to the line is thereby protected against damage.

There is a danger that the leakage current may gradually increase with time for even ordinary line voltages due to the deterioration of the nonlinear resistance, such as from passing excessive surge currents or the like. When the leakage current reaches some threshold value, for example in the multi-milliampere range, thermal runaway may occur followed by the thermal destruction of the arrester. It is therefore always necessary to confirm that the leakage current is below some predetermined level by detecting it under rated voltage conditions.

In the conventional lightning arrester of FIG. 1 it is difficult to accurately monitor the leakage current deterioration since the ammeter 16 detects both the leakage current flowing through the nonlinear resistance discs and that flowing down along the flanged surface of the ceramic casing 1. The latter may provide a path by reason of atmospheric salt deposits on the surface of the casing, a damp environment, etc. To ensure accurate leakage current monitoring in the conventional lightning arrester it is thus necessary to periodically clean the surface of the ceramic casing, during which time the line voltage must be interrupted.

SUMMARY OF THE INVENTION

It is an object of this invention to provide a new and improved lightning arrester which is able to accurately detect the leakage current flowing through a nonlinear resistance and thereby accurately monitor the deterioration of the arrester.

This object is accomplished by providing a lightning arrester of the type described above, wherein the conductive lower end plate is insulated from the lower metal cover ring, and the ammeter lead is passed through the skirt of the cover ring but insulated therefrom and connected to the end plate. The ceramic casing surface current thus flows directly to ground through the cover ring skirt, and the ammeter detects only the leakage current flowing through the nonlinear resistance.

DETAILED DESCRIPTION OF THE PREFERRED EMBODIMENTS

Figure 1:
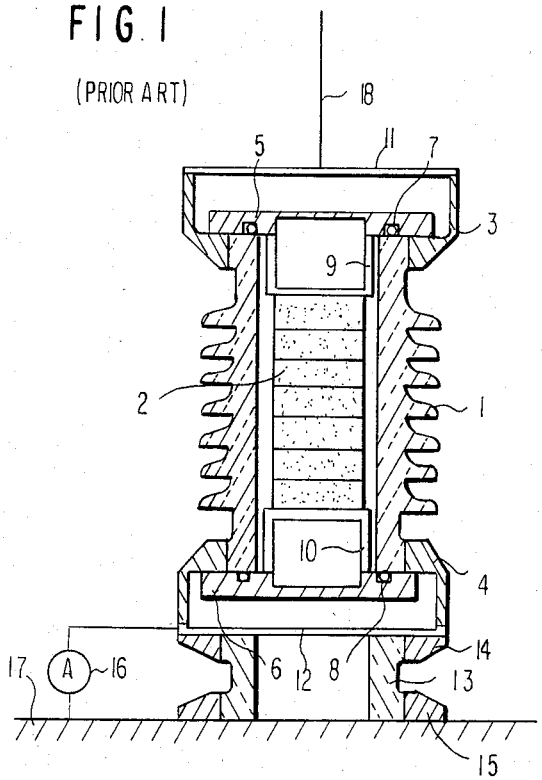
FIG. 1 (PRIOR ART)
FIG. 1 is a longitudinal sectional view of a conventional lightning arrester.
Figure 2:
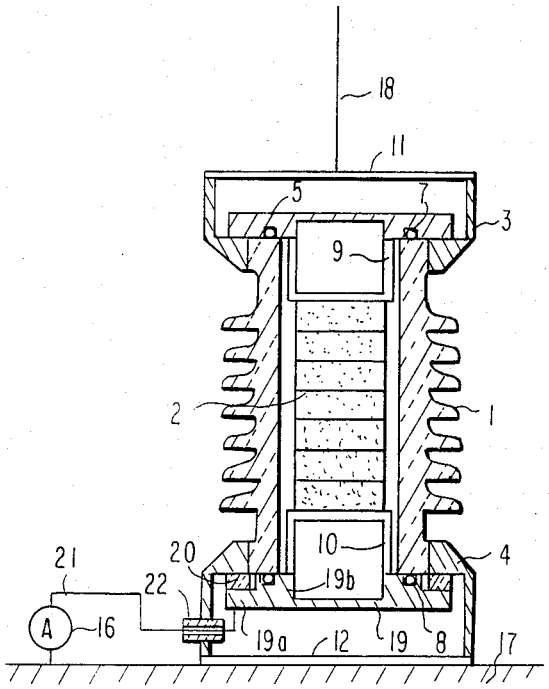
FIG. 2 is a longitudinal sectional view of a lightning arrester constructed in accordance with a first embodiment of this invention.

In accordance with the embodiment of the invention shown in FIG. 2, a conductive plate 19 is mounted on the bottom of the arrester assembly and has a thick collar portion **19*a* facing the annular metal cover ring 4, a thick sealing portion 19*b* having an annular groove for the O-ring 8, and a reduced thickness rupturable central portion. An annular insulating member 20 is mounted between the collar portion 19*a* and the ring 4, with the plate 19 being attached by insulating bolts (not shown) extending through the collar portion and the insulating member. A lead wire 21 is connected between the conductive plate 19 and the ammeter 16 through an insulating sleeve 22 which penetrates a lower skirt portion of the ring 4. Since the insulating sleeve separates the casing surface leakage current from the resistance leakage current, and since the casing surface current flows through the ring 4 to ground, the ammeter 16** detects only the desired leakage current flowing through the nonlinear resistance and thereby accurately monitors the deterioration thereof.

The thick sealing portion **19*b* provides mechanical strength, and seals the lower end of the ceramic casing 1**.

Figure 3:
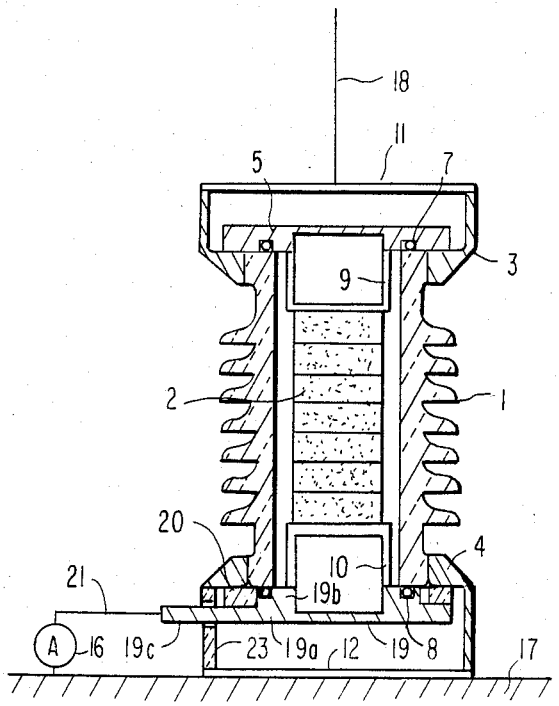
FIGS. 3, 4, 5, 6 and 7 are similar longitudinal sectional views showing further embodiments of this invention.

In the FIG. 3 embodiment a projection **19*c* integral with the conductive plate 19 passes through an insulating plate insert 23 in the cover ring skirt, whereby the end of the projection 19*c* and the ammeter 16** are both disposed outside of the ceramic casing and may be more easily connected.

Figure 4:
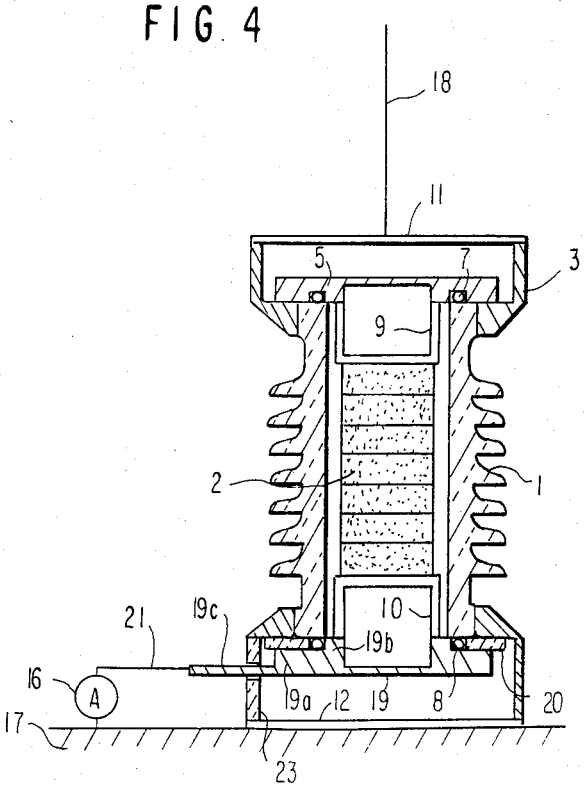

In the FIG. 4 embodiment the O-ring 8 is disposed in the space formed between the outside of the thick sealing portion **19*b* and the inside of the annular insulating member 20**, which enables the machining of the O-ring groove to be eliminated.

Figure 5:
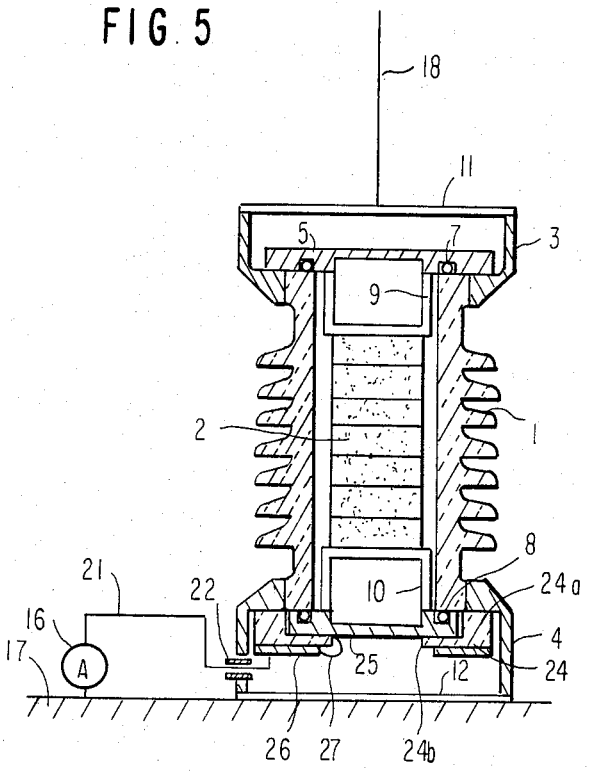

In the FIG. 5 embodiment an annular insulating member 24 is provided having a thick outer portion 24*a* abutting the ring 4 and a reduced thickness inner flange portion 24*b* supporting a conductive plate 25 similar to the conductive plate 19 in FIG. 2. The insulating member 24 is fixed to the ring 4 by insulating bolts (not shown) passing through both the insulating member and an annular metal reinforcing plate 26 connected to the conductive plate 25 by lead wire 27 and to the ammeter 16 in the same manner as the FIG. 2 embodiment.

Figure 6:
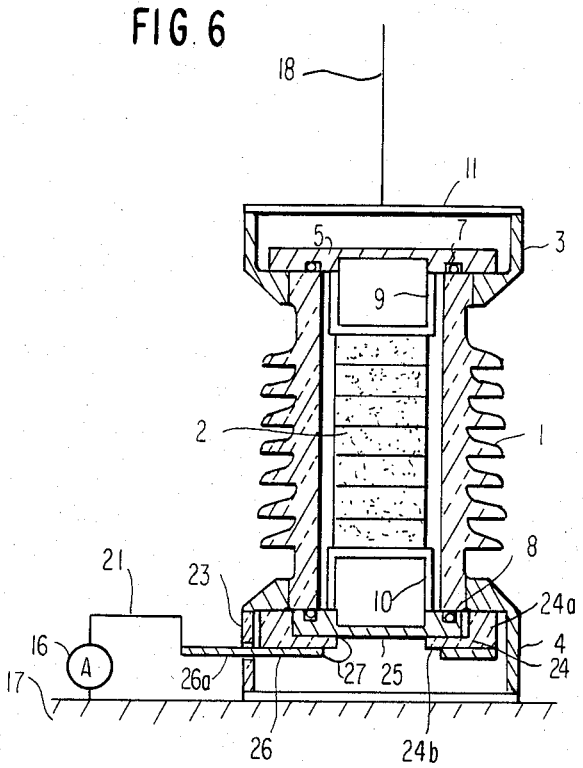

FIG. 6 shows a further form of the invention, wherein the annular metal reinforcing plate 26 has an integral projection 26*a* passing through an insulating plate insert 23 in the same manner as the FIG. 3 embodiment.

Figure 7:
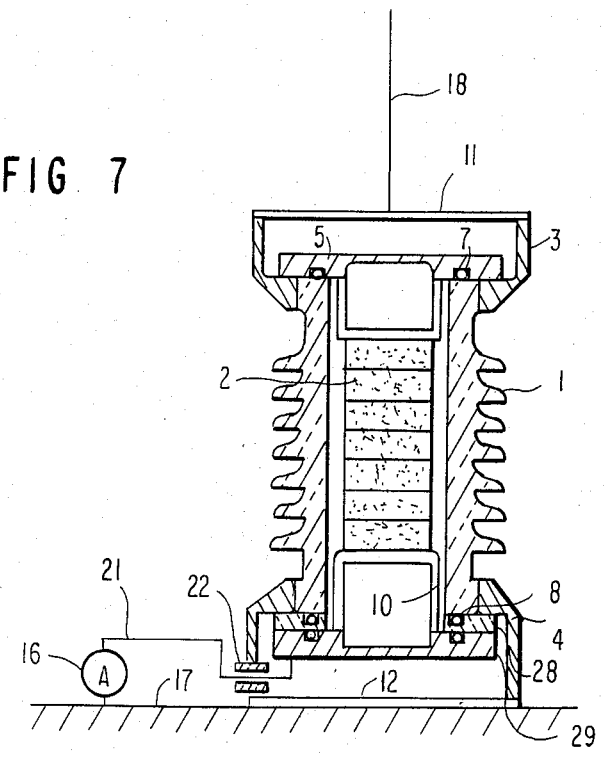

In the FIG. 7 embodiment an annular insulating member 28 abuts the bottom surface of the ceramic casing 1 and the lower inside of the ring 4, and is mounted between the ceramic casing 1 and a conductive plate 29. The insulating member 28 and the conductive plate 29 each have respective O-ring seals.

What is claimed is:

1. A lightning arrester, compising:

(a) a nonlinear resistance (2) mounted within a ceramic casing (1), (b) a pair of generally annular metal cover rings (3) (4) having upstanding cylindrical side walls, said rings being individually fixed to opposite upper and lower outer end portions of said casing, (c) a pair of conductive plates (5)(19) having reduced thickness central portions adapted to rupture upon the generation of an abnormal pressure within said ceramic casing, said conductive plates being individually sealingly mounted to opposite upper and lower ends of said ceramic casing within the respective cover rings, (d) an insulating member (20) mounted between a lower, grounded one of said cover rings (4) and a lower one of said conductive plates (19), and (e) current detecting means (16) connected between said lower conductive plate and ground by conductive means insulated from and passing through said lower cover ring to detect leakage current flowing only through said nonlinear resistance.

2. A lightning arrester according to claim 1, wherein said lower conductive plate has a sealing portion (19*b*) provided with an annular groove for receiving an O-ring (8).

3. A lightning arrester according to claim 1, wherein said conductive means comprises a projection (19*c*) on said lower conductive plate.

4. A lightning arrester according to claim 1, wherein said lower conductive plate has a sealing portion (19*b*) surrounded by a recess forming a space between an outside of said plate and an inside of said insulating member for receiving an O-ring (8).

5. A lightning arrester according to claim 1, wherein said insulating member has a relatively thick outer portion (24*a*) abutting said lower cover ring and a reduced thickness inner portion (24*b*) supporting said lower conductive plate, said insulating member is reinforced by a metal plate (26) attached to a bottom of said insulating member, and said metal plate is connected to said conductive plate and said current detecting means.

6. A lightning arrester according to claim 5, wherein said conductive means comprises a projection (26*a*) on said reinforcing metal plate.

7. A lightning arrester according to claim 1, wherein said insulating member (28) has an upper face abutting the bottom of said ceramic casing and a lower inside surface of said lower ring, said insulating member being mounted between said ceramic casing and said conductive plate.

8. A lightning arrester according to claim 1, wherein said conductive means comprises a lead wire (21) insulated from said lower cover ring by an insulating sleeve (22).

* * * * *